US006895686B1

(12) United States Patent
Sabbatini

(10) Patent No.: US 6,895,686 B1
(45) Date of Patent: May 24, 2005

(54) HAIRDRYER INCLUDING A IONIZING DEVICE

(76) Inventor: Roberto Sabbatini, Via C. Botta, 19, I-20135 Milano (IT)

( * ) Notice: Subject to any disclaimer, the term of this patent is extended or adjusted under 35 U.S.C. 154(b) by 0 days.

(21) Appl. No.: 10/811,713

(22) Filed: Mar. 29, 2004

(30) Foreign Application Priority Data

Nov. 11, 2003 (IT) ..... MI20030528 U

(51) Int. Cl.[7] ..... A45D 20/00
(52) U.S. Cl. ..... 34/96; 34/97; 392/380; 392/385
(58) Field of Search ..... 34/96, 97, 98; 392/380, 383, 384, 385

(56) References Cited

U.S. PATENT DOCUMENTS 5,612,849 A * 3/1997 Prehodka et al. ..... 361/213
5,875,562 A * 3/1999 Fogarty ..... 34/97
5,975,090 A * 11/1999 Taylor et al. ..... 132/116
6,191,930 B1 * 2/2001 Ramchandani ..... 361/213
6,640,049 B1 * 10/2003 Lee et al. ..... 392/385

FOREIGN PATENT DOCUMENTS

GB 2067071 A * 7/1981

* cited by examiner

*Primary Examiner*—Jiping Lu
(74) *Attorney, Agent, or Firm*—Hedman & Costigan, P.C.

(57) ABSTRACT

Hairdryer-ionizing device assembly including a box-like body for holding a suction part, a fan, a driving motor, a heater, an air flow outlet part, an electric switch assembly and an ion emitting device comprising a high voltage generator, from AC to DC, which is electrically coupled to an electrode, and being characterized in that the high voltage generator device is arranged at an intermediate region between the suction part and the air flow outlet part.

2 Claims, 2 Drawing Sheets

HAIRDRYER INCLUDING A IONIZING DEVICE

BACKGROUND OF THE INVENTION

The present invention relates to a hairdryer including a ionizing device.

As is known, upon brushing or combing, air is electrostatically charged.

This electrostatic charge causes some drawbacks, such as a great difficulty in holding hair in a proper arrangement and preventing it from accumulating powder and impurity.

It has been found that negative ions tend to reduce or fully overcome the above mentioned problems.

Moreover, said ions, upon drying hair, greatly reduce the size of the water drops, thereby facilitating the processing of hair, since it is affected by an uneven moisture degree.

Thus, ion emitting hairdryers have already proposed, operating based on the above mentioned operating principle, but including different constructional means for generating ions.

Actually, prior ionic hairdryers included ionizing devices designed for providing weak ion emissions, generated by a mechanic piezoelectric system.

Further prior ionic hairdryers provided to use electronic ion generators or sources which, however, because of their comparatively large sizes, were housed in the hairdryer handle or outside therefrom.

These latter hairdryers, more specifically, conventionally comprised a needle-like electrode, or diffuser, arranged near the hairdryer air outlet, to reduce the distance of the ionizing flow from air.

SUMMARY OF THE INVENTION

The aim of the present invention is to provide such a hairdryer-ionizing device assembly specifically designed for overcoming the above mentioned drawbacks of the mentioned prior art.

Within the scope of the above mentioned aim, a main object of the invention is to provide a hairdryer, including a ionizing device arranged in a much more efficient manner, both from a functional standpoint and from a size standpoint.

Another object of the invention is to provide such a hairdryer-ionizing device assembly which can be made starting from easily available materials and methods.

According to one aspect of the present invention, the above mentioned aim and objects, as well as yet other objects, which will become more apparent hereinafter, are achieved by a hairdryer, including an ionizing device, comprising a box body for holding a suction part, fan means, motor means, heater means, an air flow outlet part, electric switching means and an ion emitting device, constituted by a high voltage, from AC to DC, generator device, electrically coupled to an electrode, characterized in that said high voltage generator device is arranged at an intermediate region between said suction part and said air flow outlet part.

BRIEF DESCRIPTION OF THE DRAWINGS

Further characteristics and advantages of the present invention will become more apparent hereinafter from the following detailed disclosure of a preferred, though not exclusive, embodiment of the invention which is illustrated, by way of an indicative, but not limitative, example in the accompanying drawings, where.

DESCRIPTION OF THE PREFERRED EMBODIMENT

Figure 1:
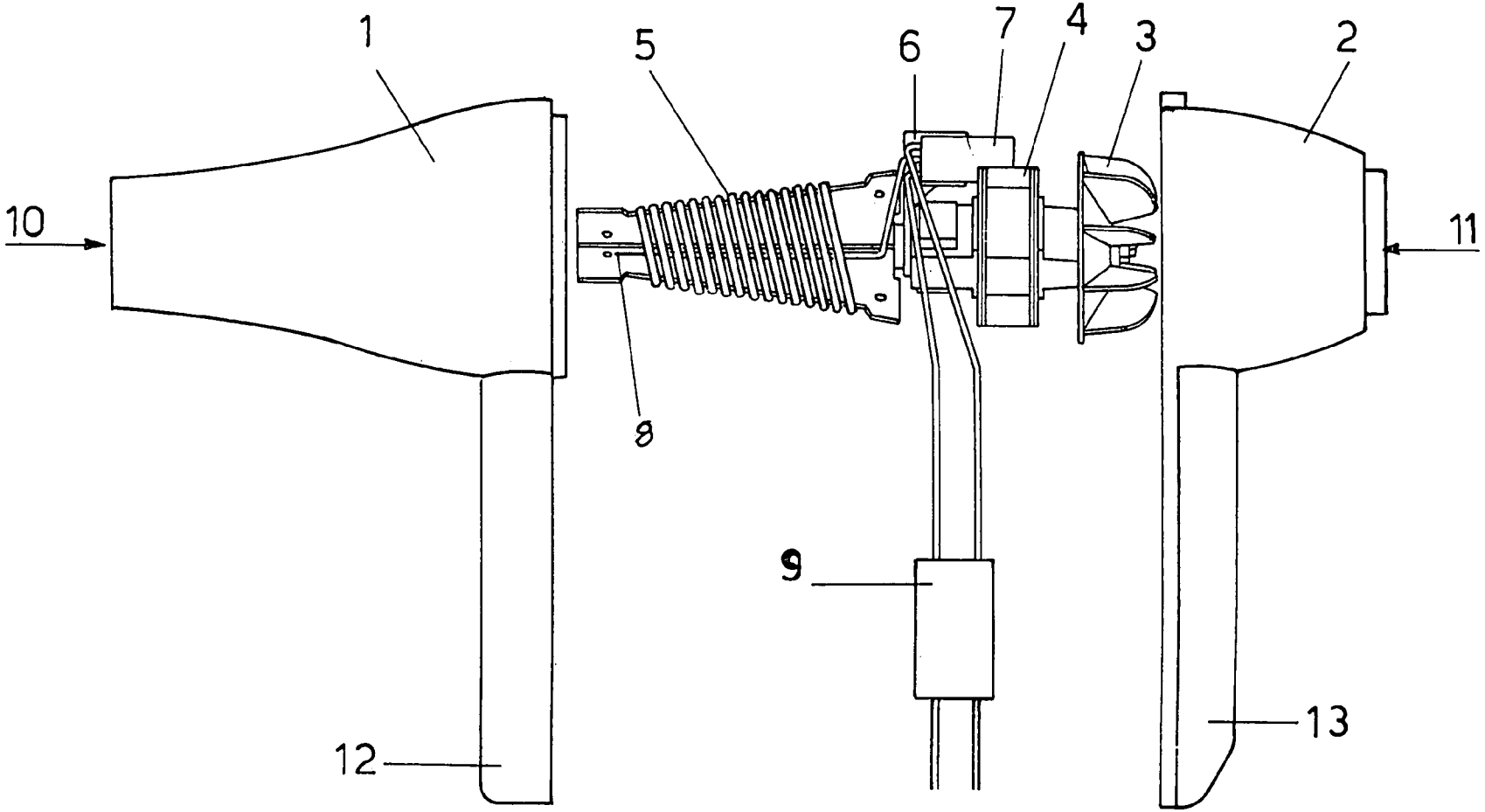
FIG. 1 is an exploded side view of the hairdryer including a ionizing device according to the present invention.

With reference to the number references of the above mentioned figures, the hairdryer-ionizing device assembly according to the present invention comprises a box-like body, including a front shell 1 having an air outlet 10 and a half-handle 12, and a rear shell 2.

The rear shell 2 comprises an air suction inlet 11 and a half-handle 13 which, upon joining the mentioned shells, will provide, together with the front half-handle 12, the handle proper of the hairdryer.

The top portion of the assembled box-like body 1, 2 holds therein a suction part 11, a fan 3, an electric motor 4, a metal wire resistance 5, mounted about a micanite supporting element, and an air flow outlet 10.

The bottom portion of the box-like body, in turn, comprises switch means, optionally mounted on a printed board defined by the assembly 9, provided for mounting thereon diodes or other electronic components.

The disclosed assembly is coupled by suitable wiring means, and is connected to the electric power outer net through an electric cable.

According to the invention, the high voltage ion generator ionizing device 7, which is arranged in a single casing, is located between the fan 3 and resistance 5, to allow said ionizing generator to be properly cured by air generated by the mentioned fan.

Figure 2:
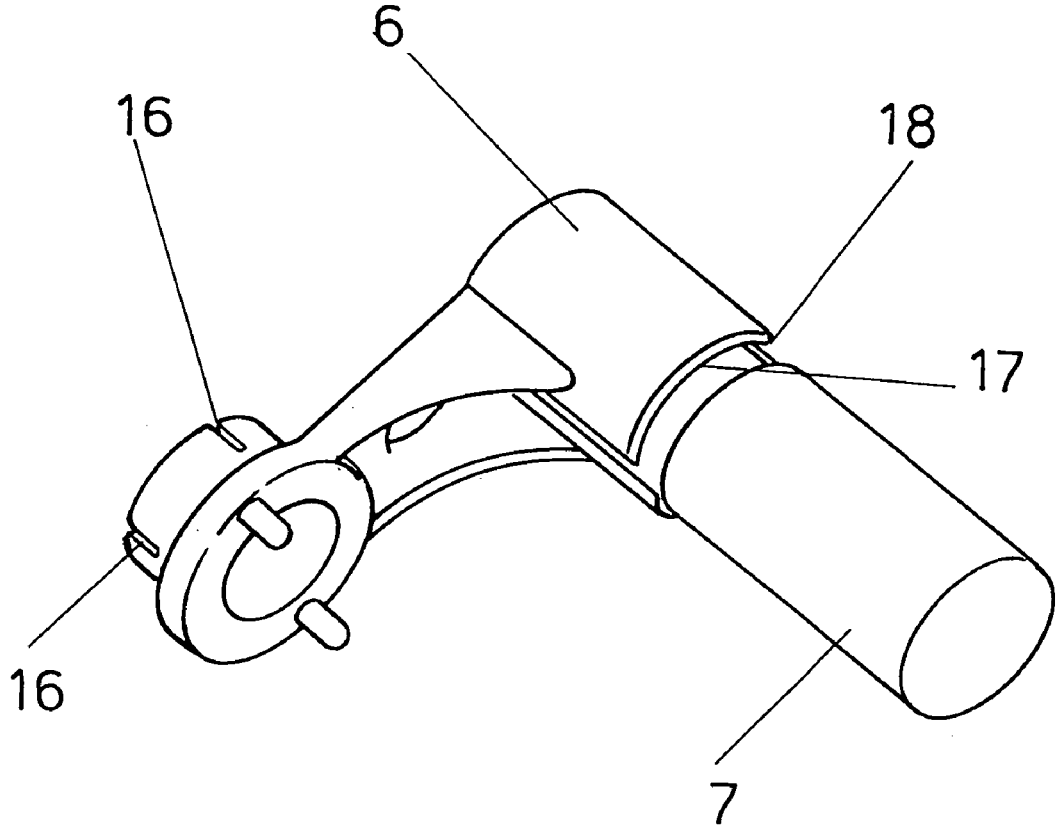
FIG. 2 is a perspective view of the hairdryer assembly, comprising a support element and a ionizing high voltage device associated with the hairdryer according to the present invention.

The ionizing device 7, which has preferably a cylindric shape, is applied to a resistance bearing support element 6, which is clearly shown in FIG. 2.

Said ionizing device 7 is, advantageously, an easily commercially available miniaturized device, designed for transforming. AC current (at 110–220 volts) to DC current of high voltage (4–5 kV).

The support element 6, which is preferably made of a plastic material, defines an intermediate element between the electric motor 4 and resistance 5 and is designed for supporting the heater element and said ionizing device 7.

The support element 6 supports, at the bottom thereof, on a side the resistance 5, through a cross cut or simple cut 16 and, at the other side supporting the electric motor 4 preferably by two pegs.

The support element 6 comprises moreover, at it top portion, a cylindric recess 17, made resilient by a top cut 18, for engaging therein the ionizing device 7.

An electrode or tip 8 is coupled on the heater element 5.

Said electrode can also be arranged in a different manner, on the front body or near the air outlet.

With respect to the operation of the hairdryer according to the present invention, the ion emission can be either continuous, as the apparatus operates, or it can occur as hot air or cold air is emitted.

Furthermore, the ion flow can be interrupted by a specifically designed switching means.

It has been found that the invention fully achieves the intended aim and objects.

In fact, the invention provides a hairdryer including a specifically designed supporting element adapted to hold and properly locate therein the ion generating high voltage device, to facilitate hair processing.

In practicing the invention, the used materials, as well as the contingent size and shapes can be any, depending on requirements.

What is claimed is:

1. A hairdryer, including an ionizing device, comprising a box body for holding a suction part, a fan, a electric motor, a metal wire resistance heater assembled about a supporting micanite element, an air flow outlet part, electric switching means and an ion generator device, constituted by a high voltage, from AC to DC, a generator device being arranged at an intermediate region between said suction part and said air flow outlet part, said box body comprising a front shell, including said air flow outlet part and a half-handle and a rear shell, including an air flow inlet part and a further half-handle, said further half-handle cooperating with said front half handle to provide, upon joining said shells, a handle for the hairdryer, said box body further comprising a bottom portion including switching means mounted on a printed board circuit, said ion generator device being arranged between said fan and metal wire resistance heater, said ion generator device having a cylindric configuration and being supported by a metal wire resistance bearing plastic material support element arranged between said electric motor and metal wire resistance heater, wherein said support element comprises a bottom portion, holding, on a side, said metal wire resistance heater through a cross cut or a simple cut and, on the other side, said electric motor.

2. A hairdryer, according to claim 1, wherein said support element comprises a top portion including a cylindric recess made resilient by a top cut for engaging therein said ionizing device.

* * * * *